US010262637B1

(12) United States Patent
Salerno

(10) Patent No.: US 10,262,637 B1
(45) Date of Patent: Apr. 16, 2019

(54) ELECTRONIC KEYBOARD ALIGNMENT TOOL AND METHOD OF USE

(71) Applicant: Russell Stephen Salerno, Dix Hills, NY (US)

(72) Inventor: Russell Stephen Salerno, Dix Hills, NY (US)

( * ) Notice: Subject to any disclaimer, the term of this patent is extended or adjusted under 35 U.S.C. 154(b) by 0 days.

(21) Appl. No.: 15/924,192

(22) Filed: Mar. 17, 2018

(51) Int. Cl.
*G10G 7/00* (2006.01)
*G10C 9/00* (2019.01)
*G10H 1/34* (2006.01)

(52) U.S. Cl.
CPC ..... *G10G 7/00* (2013.01); *G10H 1/344* (2013.01)

(58) Field of Classification Search
CPC ..... G10G 7/00; G10H 1/344; G10C 9/00
See application file for complete search history.

(56) References Cited

U.S. PATENT DOCUMENTS 834,468 A * 10/1906 Hale ..... G10C 9/00 84/459
3,087,368 A 4/1963 Lund
3,828,110 A 8/1974 Colin
3,845,683 A 11/1974 Lehmann
4,418,605 A 12/1983 Tollefsen et al.
6,727,416 B1 * 4/2004 Vale ..... G10C 3/18 84/458
6,888,056 B2 * 5/2005 Leonard ..... G10C 9/00 84/200
7,186,909 B2 * 3/2007 Bee, Jr. ..... G10C 9/00 84/459
7,638,702 B2 * 12/2009 Fujan ..... G10C 9/00 81/22
7,893,335 B2 * 2/2011 Szczap ..... G10C 9/00 84/433
8,049,090 B1 * 11/2011 Voit ..... G10C 9/00 84/423 R
8,865,989 B1 * 10/2014 Voit, II ..... G10C 9/00 84/433
2008/0121089 A1 5/2008 Rawson
2010/0064879 A1 3/2010 Szczap

OTHER PUBLICATIONS

Synthrodriguez, Re: Pratt-Read keyboard rebushing issue, Internet posting dated Sep. 22, 2012 at http://forum.vintagesynth.com/viewtopic.php?f=5&t=69141#p676915, last visited Mar. 16, 2018.

* cited by examiner

*Primary Examiner* — Robert W Horn
(74) *Attorney, Agent, or Firm* — The Salerno Law Firm, P.C.

(57) ABSTRACT

A musical instrument keyboard alignment tool comprises a central member having defined therein a slot dimensioned to receive a key stop member of an electronic musical instrument keyboard, at least one handle extending from the central member, and an elongate foot extending from the central member. A distance between the bottom of the slot to the bottom surface of the foot corresponds to a calibration distance from the bottom of a key stop to a reference portion of the key bed of a keyboard. The described tool and methods of use significantly reduces the time required to perform a complete key stop alignment of an electronic musical instrument keyboard.

12 Claims, 4 Drawing Sheets

ELECTRONIC KEYBOARD ALIGNMENT TOOL AND METHOD OF USE

BACKGROUND

1. Technical Field

The present disclosure relates generally to the maintenance and refurbishment of a keyboard for an electronic musical instrument, and in particular, to a tool for adjusting and aligning individual key stops of an electronic musical instrument keyboard.

2. Background of Related Art

Electronic organs, pianos, synthesizers and other electrical musical instruments include keyboards with switches which are operated to activate tone generators, or to key signals therefrom, to selectively provide signals representing various musical notes. One such keyboard is disclosed in U.S. Pat. No. 3,845,683, issued Nov. 5, 1974 to Alfred H. Lehmann, assigned to Pratt-Read Corporation, which is incorporated by reference herein. The keyboard design described therein has enjoyed great commercial success and has received many accolades for its durability and playability. However, wear and tear combined with the effects of age-related deterioration of certain components will eventually require refurbishment of the keyboard to maintain good performance.

In particular, the keyboard includes individual keys stops, one for each key, which define the upper and lower limits of key travel. The key stops include a neoprene sleeve (sometimes referred to as a "bumper" or "bushing") which absorbs the impact of the key hitting the key stop to provide a pleasing feel to the player and to eliminate mechanical clacking noises. Repeated blows over years of playing eventually cause the key stops to deform, which throws the keys out of alignment. This causes unevenness between the keys, impairing the playability and aesthetic appearance of the instrument. In addition, the resilient sleeves eventually dry out and become brittle, losing their impact-absorbing qualities and exacerbating deformation of the key stops.

Refurbishment of such a keyboard is a laborious and time-consuming task. During refurbishment, a technician will typically remove the old resilient sleeves and carefully align the key stops to original specifications before installing a new set of resilient sleeves. Aligning key stops is a painstaking and time consuming process that involves repeated measurements with a ruler and straightedge, and bending the stops with pliers, to bring all the key stops into proper alignment. In addition, the shape and spacing of the key stops makes it difficult to grasp without twisting or, worse, breaking off the key stop. Mere visual inspection can determine consistency among key stops but cannot reveal pervasive alignment errors. A cost-effective and time-saving solution to these shortcomings would be a welcome advance in the art.

SUMMARY

In one aspect, the present disclosure is directed to an electronic musical instrument keyboard alignment tool. In an exemplary embodiment, the tool includes a central member having defined therein a slot dimensioned to receive a key stop of an electronic musical instrument keyboard, at least one handle extending from the central member, and an elongate foot extending from the central member. IN embodiments, the slot is L-shaped. A distance d between a bottom surface of the slot and a bottom surface of the foot corresponds to a calibration distance from the bottom of a key stop to a reference portion of the key bed of a keyboard. In some embodiments, the distance d is about 36 mm.

In some embodiments, the tool includes a handle extending vertically from the central member. In some embodiments, the tool includes a handle extending horizontally from the central member. In some embodiments, the length of the elongate foot is adjustable.

In another aspect, the present disclosure is directed to a method of aligning a key stop of an electronic musical instrument keyboard. In an exemplary embodiment, the method includes providing a tool as described herein, engaging the slot of the tool with the key stop to be adjusted, and manipulating the tool to bring the key stop into proper alignment. In embodiments, the method includes confirming proper alignment of the key stop by observing that a bottom surface of the elongate foot is in light contact with a surface of a key bed support rail. In embodiments, the method includes adjusting the length of the elongate foot.

In yet another aspect, the present disclosure is directed to an electronic musical instrument keyboard alignment kit. In an exemplary embodiment, the kit includes a plurality of electronic musical instrument keyboard alignment tools as described herein. Each one of the plurality of electronic musical instrument keyboard alignment tools includes a different distance d to account for different alignment standards. In some embodiments, the distance d of individual ones of the plurality of electronic musical instrument keyboard alignment tools ranges from about 35 mm to about 37 mm in 0.5 mm increments.

BRIEF DESCRIPTION OF THE DRAWINGS

Various embodiments of the disclosed system and method are described herein with reference to the drawings wherein.

Figure 1:
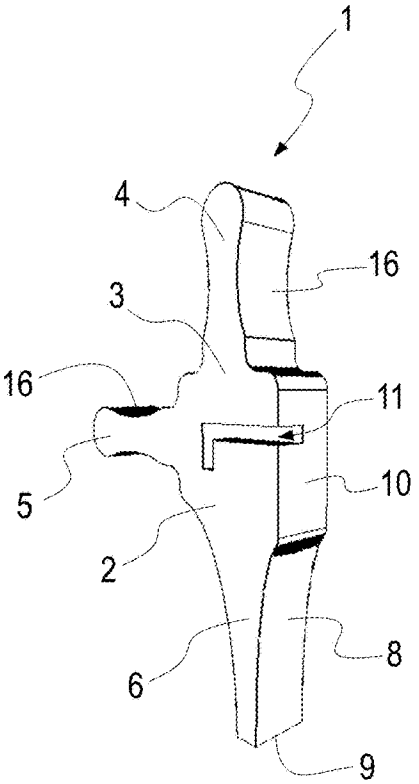
FIG. 1 is a perspective view of a musical instrument keyboard alignment tool in accordance with an embodiment of the present disclosure.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings, however, the disclosed embodiments are merely examples of the disclosure, which may be embodied in various forms. Well-known functions or constructions and repetitive matter are not described in detail to avoid obscuring the present disclosure in unnecessary or redundant detail. Therefore, specific structural and functional details disclosed herein are not to be interpreted as limiting, but as a basis for the claims and examples for teaching one skilled in the art to variously employ the present disclosure in any appropriately-detailed structure. By the terms "substantially" or "about" it is meant that the recited characteristic, parameter, or value need not be achieved exactly, but that deviations or variations, including for example, tolerances, measurement error, measurement accuracy limitations and other factors known to those of skill in the art, occur in amounts that do not preclude the effect the characteristic was intended to provide. In addition, as used herein, terms referencing orientation, e.g., "top", "bottom", "upper", "lower", "left", "right", and the like, are used with reference to the figures and features shown and described. It is to be understood that embodiments in accordance with the present disclosure may be practiced in any orientation without limitation. In this description, as well as in the drawings, like-referenced numbers represent elements which may perform the same, similar, or equivalent functions. The word "exemplary" is used herein to mean "serving as a non-limiting example, instance, or illustration." Any embodiment described herein as "exemplary" is not necessarily to be construed as preferred or advantageous over other embodiments. The word "example" may be used interchangeably with the term "exemplary."

FIGS. 1-6 illustrate an exemplary embodiment of a keyboard alignment tool 1 in accordance with the present disclosure. Tool 1 includes a central member 2 having a front face 3, a back face 13, a top face 14, a left side face 15, and right side face 10. A first handle 4 extends upwardly from top face 14 of central member 2. A second handle 5 extends away, e.g., leftwardly, from left face 15 of central member 2. Handles 4 and 5 include opposing finger reliefs 16 on either side thereof to improve the comfort and grip of tool 1 in the hand, and may additionally or alternatively include friction enhancing features such as, without limitation, knurling, ridges, rubberized grips, and the like. The combination of handles 4 and 5 are configured to provide good control and sufficient leverage to facilitate the alignment of an electronic keyboard key stop while minimizing the risk of over-bending or damaging the delicate key stops.

An elongate pedestal 6 extends downwardly from central member 2 and includes a foot 9 at a bottom end thereof. Pedestal 6 includes a left arcuate surface 7 and a right arcuate surface 8. During use while adjusting key stops of an electronic keyboard, the arcuate contour of right arcuate surface 8 provides clearance between tool 1 and a front portion of the key bed of the keyboard, as discussed in more detail below.

Preferably, tool 1 has a depth (e.g., as measured along a line orthogonally extending from front face 3 to back face 13) that allows tool 1 to be interposed between adjacent key stops of an electronic musical instrument keyboard. In an embodiment tool 1 has a depth of about 8 mm.

Central member 2 includes an L-shaped slot 11 defined therein that is open to right side face 10 and dimensioned to receive a key stop of an electronic musical instrument keyboard. In an embodiment, slot 11 has a depth of about one-half that of tool 1, or about 4 mm. In another embodiment, slot 11 has a depth equal to that of tool 1, i.e., slot 11 extends from right side face 10 through left side face 15. In some embodiments, slot 11 may additionally or alternatively be defined in left side face 15. In any case, slot 11 should be of sufficient depth to securely retain a key stop therein during use of the tool such that tool 1 cannot undesirably disengage (e.g., slip off) the key stop. In some embodiments, slot 11 may be tapered to enable the key stop to wedge into position therein to enhance stability during an adjustment procedure.

Slot 11 includes a width (e.g., as measured along a line orthogonally extending from a lower surface 12 of slot 11 to an upper surface 17 of slot 11) that enables a key stop to engage slot 11 with negligible play and resistance. In an embodiment, the width of slot 11 is about 2 mm.

Figure 2:
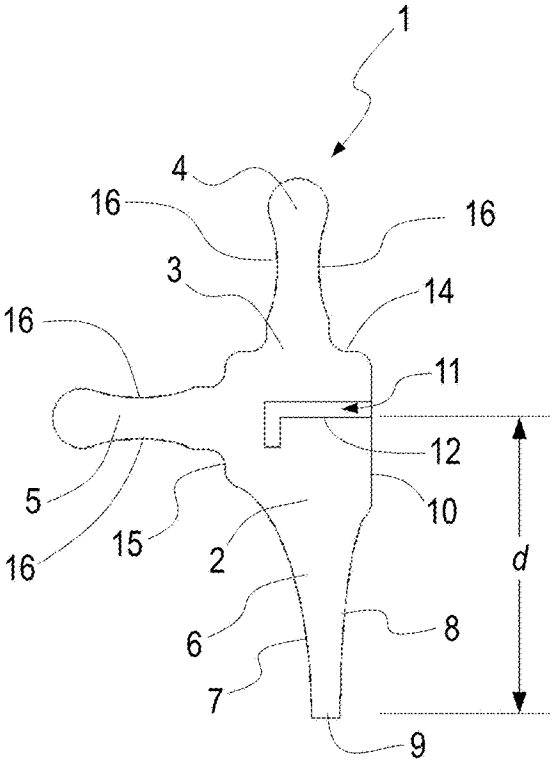
FIG. 2 is a front plan view of a musical instrument keyboard alignment tool in accordance with an embodiment of the present disclosure.
Figure 3:
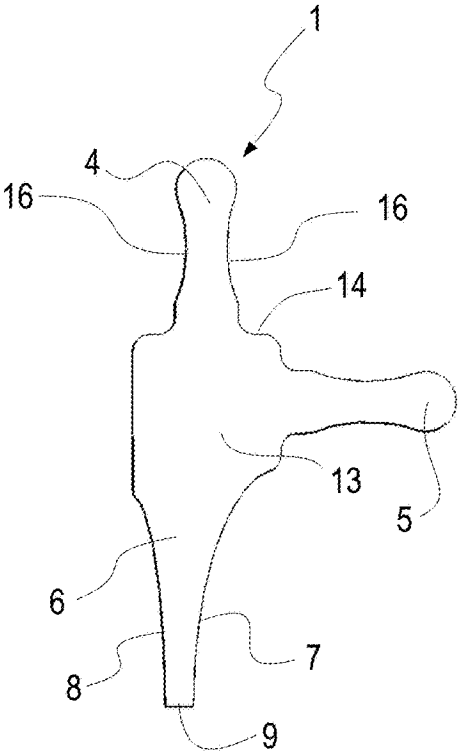
FIG. 3 is a rear plan view of a musical instrument keyboard alignment tool in accordance with an embodiment of the present disclosure.
Figure 6:
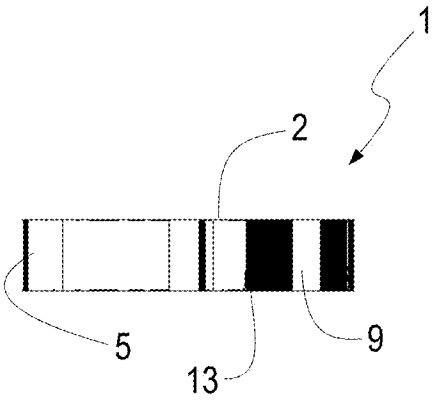
FIG. 6 is a bottom plan view of a musical instrument keyboard alignment tool in accordance with an embodiment of the present disclosure.
Figure 5:
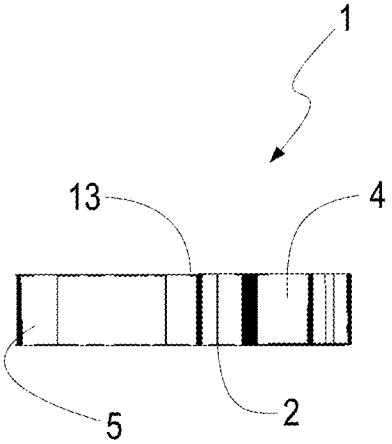
FIG. 5 is a top plan view of a musical instrument keyboard alignment tool in accordance with an embodiment of the present disclosure.
Figure 4:
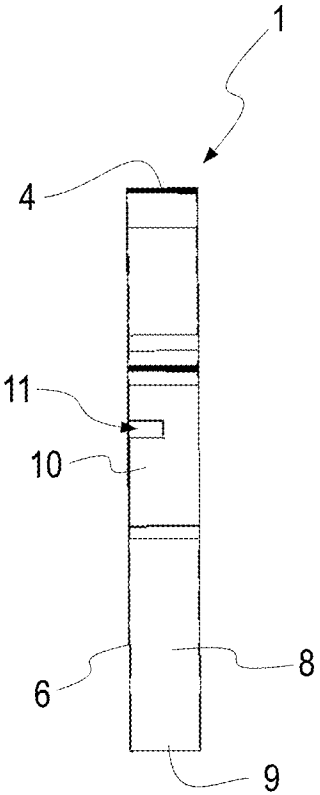
FIG. 4 is a side plan view of a musical instrument keyboard alignment tool in accordance with an embodiment of the present disclosure.

With particular reference to FIG. 2, a distance d between a lower surface 12 of slot 11 and the bottom of foot 9 advantageously corresponds to the ideal calibration distance from the bottom of a key stop to a reference portion of the key bed of the keyboard to be adjusted. In an embodiment, the distance d between a lower surface 12 of slot 11 and the bottom of foot 9 is about 36 mm. This also enables tool 1 to act as a go/no-go gauge, as described in more detail below.

In some embodiments, a kit of tools 1 may be provided, wherein each of a plurality of tools 1 includes a different distance d to account for different alignment standards. For example, and without limitation, a kit of five tools 1 spanning a distance d from 35 mm to 37 mm in 0.5 mm increments may be provided.

Tool 1 is preferably formed from a rigid material of sufficient toughness to withstand repeated use. Suitable materials for construction of tool 1 include, without limitation, steel, aluminum, hardwood, or a polymeric material such as nylon, fiber-reinforced plastic (FRP), acrylonitrile butadiene styrene (ABS), polylactic acid (PLA), polyoxymethylene (Delrin®), and the like. Tool 1 may be manufactured using any suitable technique, including without limitation, machining, injection molding, casting, or fusion deposition modeling (FDM).

Figure 7:
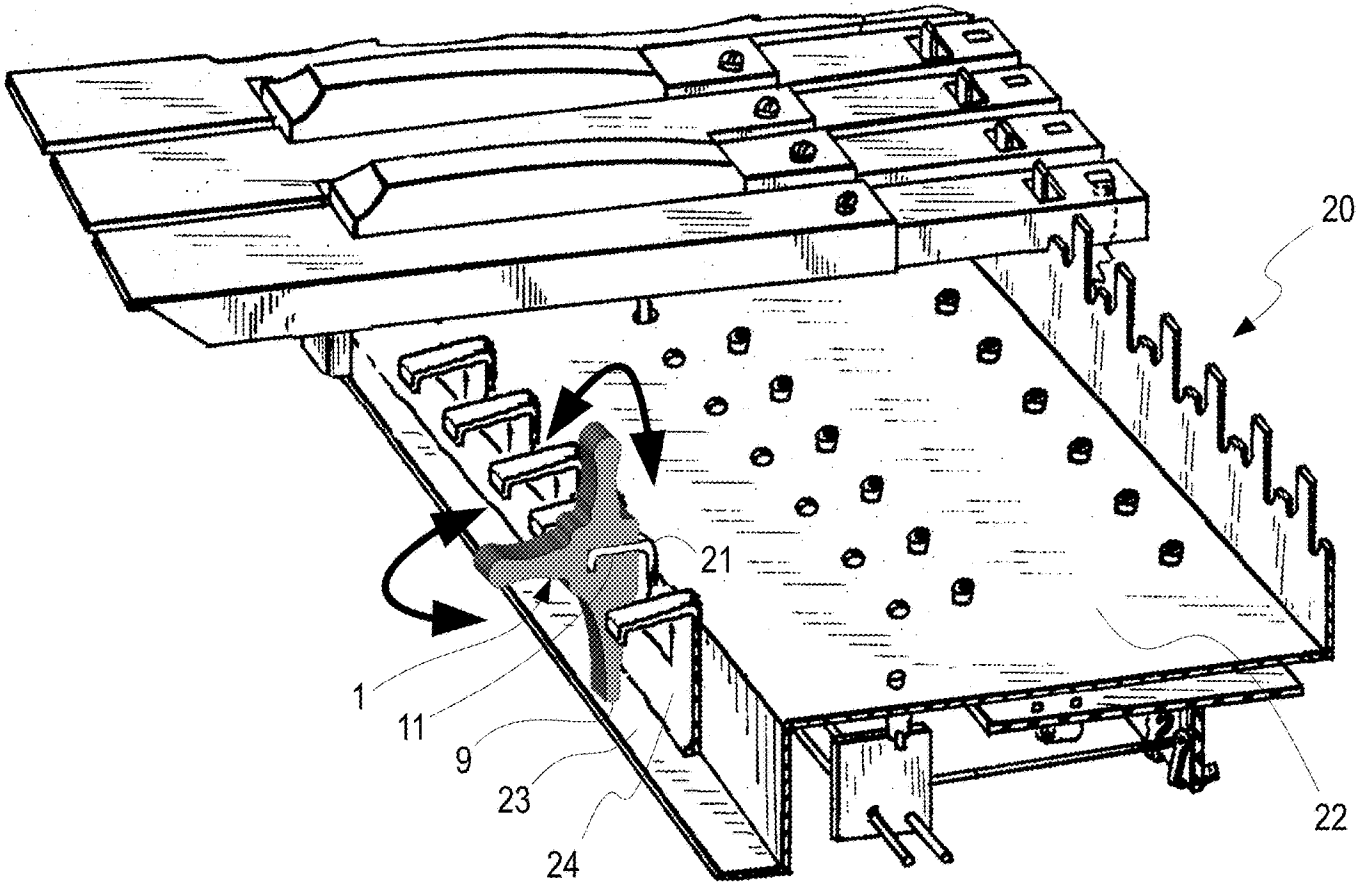
FIG. 7 illustrates a method of using a musical instrument keyboard alignment tool.

Turning now to FIG. 7, an example embodiment method for aligning key stops using the disclosed alignment tool is presented. Electronic keyboard 20 is shown in a partially disassembled state where several components have been removed to expose the key bed frame 22 and a plurality of key stops, and in particular key stop 21 which is to be aligned in the present example.

Initially, tool 1 is positioned between key stop 21 and a leftwardly-adjacent key stop, or just to the left of key stop 21. Tool 1 is then slid rightwardly to engage key stop 21 with slot 11 of tool 1. Once so engaged, tool 1 is manipulated using handles 4 and 5 to bring key stop 21 into proper alignment. Proper alignment is confirmed when foot 9 of tool 1 makes light contact with a reference portion of key bed support rail 23 at a point directly below (e.g., vertically aligned) with key stop 1. Advantageously, the right arcuate surface 8 of tool 1 provides clearance between tool 1 and a front portion 24 of the key bed to enable sufficient articulation of tool 1 to facilitate a downward adjustment when such adjustment is required.

When using an embodiment of tool 1 having a slot 11 which extends completely through central member 2 is used, key stop 21 may be engaged from either side.

The above-described method is repeated for each key stop 21 of the keyboard 20 to bring the entire keyboard into alignment. Using the described tool and method, the time required to perform a full key stop alignment of an electronic musical instrument keyboard may be decreased from over an hour to as little as five minutes.

Tool 1 may also be employed as a quick go/no-go gauge in those instances where alignment may not be indicated initially, but it is still desirable to confirm keyboard alignment. In these cases, tool 1 is used as follows: tool 1 is positioned to the left of the subject key stop 21, with foot 9 resting on key bed support rail 23. While maintaining contact between foot 9 and key bed support rail 23, tool 1 is slid rightwardly. If key stop 21 engages smoothly and without resistance into slot 11, key stop 21 is in good alignment ("go" condition). If, rather, key stop 21 catches on an edge of slot 11 or hits a portion of front face 3, key stop 21 is misaligned and further attention is required ("no-go" condition).

Figure 8B:
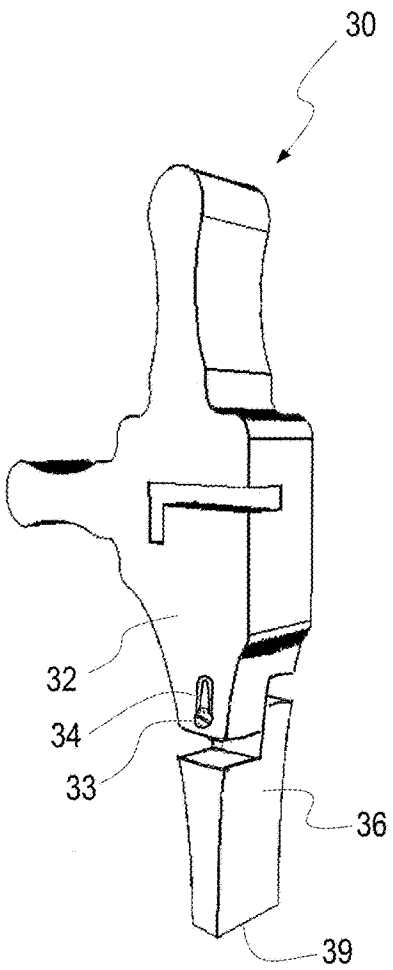
FIG. 8B is a perspective view of the FIG. 8A adjustable musical instrument keyboard alignment tool in a second adjustment position.
Figure 8A:
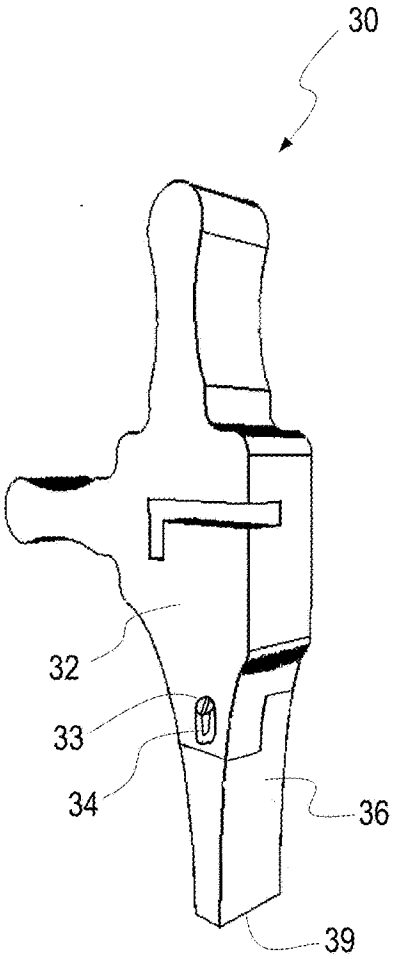
FIG. 8A is a perspective view of an adjustable musical instrument keyboard alignment tool in a first adjustment position in accordance with another embodiment of the present disclosure.

Turning now to FIGS. 8A and 8B, another exemplary embodiment of a keyboard alignment tool 30 is shown which includes an adjustment mechanism to allow the tool 30 to be tailored to a specific calibration standard. Tool 30 includes a central member 32 to which an adjustable leg 36 is slidably disposed. An adjustment screw 33 extends through a vertically oriented adjustment slot 34 defined in central member 32 into a threaded hole defined in adjustable leg 36. Adjustment screw 33 may be loosened to enable adjustable leg 36 to be positioned as desired, then adjustment screw 33 is tightened to fix adjustable leg 36 in the desired position. It should be understood that alternative variations of adjustment mechanisms are contemplated within the scope of the present disclosure, including without limitation, a threaded mechanism, a threaded mechanism that includes a jam nut, a twist-lock extension, interchangeable legs of varying length, and so forth.

Particular embodiments of the present disclosure have been described herein, however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in any appropriately detailed structure.

What is claimed is:

1. An electronic musical instrument keyboard alignment tool, comprising:

a central member having defined therein a slot dimensioned to receive a key stop of an electronic musical instrument keyboard;

at least one handle extending from the central member; and an elongate foot extending from the central member.

2. The musical instrument keyboard alignment tool in accordance with claim 1, wherein the slot is L-shaped.

3. The musical instrument keyboard alignment tool in accordance with claim 1, wherein a distance d between a bottom surface of the slot and a bottom surface of the foot corresponds to a calibration distance from the bottom of a key stop to a reference portion of the key bed of a keyboard.

4. The musical instrument keyboard alignment tool in accordance with claim 3, wherein the distance d is about 36 mm.

5. The musical instrument keyboard alignment tool in accordance with claim 1, wherein at least one handle extending from the central member includes a handle extending vertically from the central member.

6. The musical instrument keyboard alignment tool in accordance with claim 1, wherein at least one handle extending from the central member includes a handle extending horizontally from the central member.

7. The musical instrument keyboard alignment tool in accordance with claim 1, wherein the length of the elongate foot is adjustable.

8. A method of aligning a key stop of an electronic musical instrument keyboard, comprising:

providing a tool, comprising:

a central member having defined therein a slot dimensioned to receive a key stop of an electronic musical instrument keyboard;

at least one handle extending from the central member; and an elongate foot extending from the central member;

engaging the slot with the key stop; and manipulating the tool to bring the key stop into proper alignment.

9. The method of aligning a key stop of an electronic musical instrument keyboard in accordance with claim 8, further comprising:

confirming proper alignment of the key stop by observing that a bottom surface of the elongate foot is in light contact with a surface of a key bed support rail.

10. The method of aligning a key stop of an electronic musical instrument keyboard in accordance with claim 8, further comprising:

adjusting the length of the elongate foot.

11. An electronic musical instrument keyboard alignment kit, comprising:

a plurality of electronic musical instrument keyboard alignment tools, each comprising:

a central member having defined therein a slot dimensioned to receive a key stop of an electronic musical instrument keyboard;

at least one handle extending from the central member; and an elongate foot extending from the central member, wherein a distance d between a bottom surface of the slot and a bottom surface of the foot corresponds to a calibration distance from the bottom of a key stop to a reference portion of the key bed of a keyboard, and wherein each one of the plurality of electronic musical instrument keyboard alignment tools includes a different distance d to account for different alignment standards.

12. The electronic musical instrument keyboard alignment kit in accordance with claim 11, wherein the distance d of individual ones of the plurality of electronic musical instrument keyboard alignment tools ranges from about 35 mm to about 37 mm in 0.5 mm increments.

* * * * *